US007571905B2

(12) United States Patent
Kim

(10) Patent No.: US 7,571,905 B2
(45) Date of Patent: Aug. 11, 2009

(54) AUTOMATIC DOCUMENT FEEDING DEVICE AND IMAGE FORMING APPARATUS INCLUDING THE SAME

(75) Inventor: Won-taek Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 315 days.

(21) Appl. No.: 11/138,269

(22) Filed: May 27, 2005

(65) Prior Publication Data

US 2005/0263955 A1 Dec. 1, 2005

(30) Foreign Application Priority Data

May 29, 2004 (KR) ..... 10-2004-0038747

(51) Int. Cl.
*B65H 3/06* (2006.01)
*B65H 3/52* (2006.01)

(52) U.S. Cl. ..... 271/117; 271/121; 271/109; 271/245

(58) Field of Classification Search ..... 271/109, 271/160, 120, 117, 121, 245; 399/367
See application file for complete search history.

(56) References Cited

U.S. PATENT DOCUMENTS

| | | | | |
|---|---|---|---|---|
| 5,497,986 | A * | 3/1996 | Kudo | 271/122 |
| 6,307,621 | B1 * | 10/2001 | Endo et al. | 355/407 |
| 6,321,064 | B1 * | 11/2001 | Mizubata et al. | 399/370 |
| 6,640,082 | B2 * | 10/2003 | Mitomi | 399/374 |
| 6,651,971 | B2 * | 11/2003 | Tsuei | 271/109 |
| 6,792,241 | B2 * | 9/2004 | Nakagawa et al. | 399/367 |
| 7,099,619 | B2 * | 8/2006 | Choi | 399/367 |
| 2002/0033572 | A1 * | 3/2002 | Takisawa et al. | 271/109 |
| 2002/0190459 | A1 * | 12/2002 | Gaarder et al. | 271/109 |
| 2003/0160386 | A1 * | 8/2003 | Hirota et al. | 271/298 |
| 2004/0188918 | A1 * | 9/2004 | Morimoto et al. | 271/121 |
| 2004/0251600 | A1 * | 12/2004 | Amamoto | 271/152 |
| 2004/0253030 | A1 * | 12/2004 | Hamada et al. | 399/367 |

FOREIGN PATENT DOCUMENTS

| | | | |
|---|---|---|---|
| JP | 57-59790 | | 4/1982 |
| JP | 62-051521 | | 3/1987 |
| JP | 62-111840 | | 5/1987 |
| JP | 1-118469 | | 5/1989 |
| JP | 8-310668 | | 11/1996 |
| JP | 08310668 | A * | 11/1996 |
| JP | 11-246068 | | 9/1999 |
| JP | 2001-163469 | | 6/2001 |
| JP | 2002240970 | A * | 8/2002 |

* cited by examiner

*Primary Examiner*—Patrick H Mackey
*Assistant Examiner*—Luis Gonzalez
(74) *Attorney, Agent, or Firm*—Staas & Halsey LLP

(57) ABSTRACT

An automatic document feeding (ADF) device includes a document feed tray wherein documents are stacked, a shaft rotatably disposed on the document feed tray, an automatic document feeding roller rotatably coupled to the shaft and transporting the documents one by one, a bracket rotatably coupled to the shaft, a pick-up roller rotatably coupled to the bracket and picking up the documents stacked on the document feed tray by using a rotating force received from the shaft, a document stopper disposed to be able to rotate about the same axis as the pick-up roller rotates about and limiting a movement of the documents stacked on the document feed tray, a latch arm locking the document stopper to limit the movement of the documents and prevent the document stopper from rotating, and a flag rotatably coupled to the shaft and pushing the latch arm to unlock the document stopper.

25 Claims, 6 Drawing Sheets

AUTOMATIC DOCUMENT FEEDING DEVICE AND IMAGE FORMING APPARATUS INCLUDING THE SAME

CROSS-REFERENCE TO RELATED APPLICATIONS

This application claims the priority of Korean Patent Application No. 10-2004-0038747,filed on May 29, 2004, in the Korean Intellectual Property Office, the disclosure of which is incorporated herein in its entirety by reference.

BACKGROUND OF THE INVENTION

1. Field of the Invention

The present invention relates to an image forming apparatus, and more particularly, to an automatic document feeding (ADF) device feeding documents that are stacked one by one to a scanning unit scanning images recorded on the documents and an image forming apparatus including the ADF device.

2. Description of the Related Art

Generally, an image forming apparatus receives an image signal and transfers the image signal onto a sheet of paper to form a visible image. In particular, an image forming apparatus having a scanning function, such as a facsimile or a scanner, scans an image recorded on a document, converts the image into digital image information, which may be reproduced on a sheet of paper or a display. The image forming apparatus with the scanning function includes a scanning unit scanning an image on a document and an automatic document feeding (ADF) device feeding each page of the document to the scanning unit (the so-called "automatic document feeding" function).

FIG. 1 is a sectional view of a conventional ADF device. Referring to FIG. 1, the conventional ADF device includes an ADF roller 3 rotating above a document feed tray 20 and feeding documents D, and a pickup roller 8. The ADF roller 3 is coupled to an ADF roller shaft 5 powered and rotated by a driving unit (not shown), and the ADF roller shaft 5 penetrates a bracket 1. The pickup roller 8 is rotatably coupled to a pickup roller shaft 9 supported by the bracket 1.

A document stopper 10 forcing front ends of the documents D to be disposed under the pickup roller 8 is coupled to the pickup roller shaft 9. A lower end of the document stopper 10 is disposed in a slit 21 formed in the document feed tray 20, and an upper end of the document stopper 10 is caught on and locked in a hook 13 of a latch arm 12. Thus, the document stopper 10 is prevented from rotating. The latch arm 12 is rotatably coupled to a cover 15. Meanwhile, reference numeral 14 indicates a center of rotation of the latch arm 12, and an ADF pad 4 is attached to the ADF roller 3.

To be scanned, the documents D are stacked on the document feed tray 20. The front ends of the documents D are blocked by the document stopper 10, and the documents are arranged under the pickup roller 8. When a scan command is input to an image forming apparatus, the ADF roller shaft 5 rotates in a counter-clockwise direction, and so does the bracket 1. Accordingly, the pickup roller 8 descends and contacts a front end of an uppermost document D of the documents D stacked on the document feed tray 20. As the pickup roller 8 descends, the upper end of the document stopper 10 coupled to the pickup roller shaft 9 breaks away from the hook 13 of the latch arm 12 to become unlocked, and thus rotatable.

Then, the pickup roller 8 rotating in the counter-clockwise direction picks up one through several documents D and transports the one through several documents D to the ADF roller 3. The ADF roller 3 rotating in the counter-clockwise direction feeds the uppermost document D of the transported one through several documents D to a scanning unit (not shown).

When a plurality of documents D are stacked on the document feed tray 20, a weight of the documents D acts on a lower portion of the document stopper 10, thus creating tremendous friction between the hook 13 of the latch arm 12 and the upper end of the document stopper 10 that are in contact with each other.

Due to this friction, although the ADF roller shaft 5 rotates in the counter-clockwise direction in response to the scan command input to the image forming apparatus, the bracket 1 cannot rotate. Consequently, the pickup roller 8 fails to pick up the documents D, thus jamming the documents D or stalling a motor.

To solve this problem, it has been suggested that a separate motor in addition to the motor connected to the ADF roller shaft 5 be installed to rotate the bracket 1. However, this addition complicates the configuration of the ADF device, thus increasing manufacturing costs, and requires greater power consumption to drive the separate motor.

SUMMARY OF THE INVENTION

The present invention provides a reliable automatic document feeding (ADF) device comprising a document stopper that facilitates release from a latch arm in response to a scan command even though a plurality of documents are stacked on a document feed tray, and an image forming apparatus including the ADF device.

The present invention also comprises a reliable ADF device having a document stopper that facilitates release from a latch arm without an additional motor to rotate a bracket, and an image forming apparatus including the ADF device.

According to an aspect of the present invention, an ADF device comprises a document feed tray wherein documents are stacked; a shaft that is rotatably disposed on the document feed tray; an ADF roller that is rotatably coupled to the shaft and transports the documents one by one; a bracket that is rotatably coupled to the shaft; a pick-up roller that is rotatably coupled to the bracket and picks up the documents stacked on the document feed tray by using a rotating force received from the shaft; a document stopper that is disposed to facilitate rotation about the same axis as the pick-up roller rotates about and to limit a movement of the documents stacked on the document feed tray; a latch arm that locks the document stopper to limit the movement of the documents and prevent the document stopper from rotating; and a flag that is rotatably coupled to the shaft and that pushes the latch arm to unlock the document stopper.

The ADF device may further include a cover disposed on the bracket. The latch arm may be rotatably coupled to the cover and include a head portion having a hook that locks the document stopper on one end of the latch arm based on a rotation axis of the latch arm and a tail portion that is pushed by the flag on the other end of the latch arm.

The head portion of the latch arm may be heavier than the tail portion. The ADF device may further include a unit to restrict a rotation range of the latch arm. The ADF device may further include a cover disposed on the bracket. A spring interposed between the bracket and the cover may elastically bias the bracket in a direction in which the pick-up roller ascends.

The ADF device may further include a clutching unit including a clutch spring inserted into a bushing fixed to the shaft and a flange formed in the bracket to have a pressing force, rotating the bracket in a direction in which the pick-up roller descends when the shaft rotates in a predetermined direction, and having its one end inserted into a first insertion groove formed in the bracket; and a clutch sleeve being a pipe-type member surrounding the clutch spring and including a second insertion groove into which the other end of the clutch spring is inserted. The flag may protrude from an outer circumferential surface of the clutch sleeve. A slit may be formed in the document feed tray to accommodate a lower end of the document stopper.

According to another aspect of the present invention, an image forming apparatus comprises a scanning unit scanning images recorded on documents and an ADF device feeding the documents one by one to the scanning unit. The ADF device includes a document feed tray where the documents are stacked; a shaft rotatably disposed on the document feed tray; an ADF roller rotatably coupled to the shaft and transporting the documents one by one; a bracket rotatably coupled to the shaft; a pick-up roller rotatably coupled to the bracket and picking up the documents stacked on the document feed tray by using a rotating force received from the shaft; a document stopper disposed to facilitate rotation about the same axis as the pick-up roller rotates about and limiting a movement of the documents stacked on the document feed tray; a latch arm locking the document stopper to limit the movement of the documents and prevent the document stopper from rotating; and a flag rotatably coupled to the shaft and forcing the latch arm to unlock the document stopper.

The ADF device may further include a cover disposed on the bracket. The latch arm may be rotatably coupled to the cover, include a head portion having a hook that locks the document stopper on one end of the latch arm based on a rotation axis of the latch arm, and a tail portion that is pushed by the flag on the other end of the latch arm.

The head portion of the latch arm may be heavier than the tail portion. The ADF device may further include a unit to restrict a rotation range of the latch arm.

The ADF device may further include a cover disposed on the bracket. A spring interposed between the bracket and the cover may elastically bias the bracket in a direction in which the pick-up roller ascends.

The ADF device may further include a clutching unit including a clutch spring inserted into a bushing fixed to the shaft and a flange formed in the bracket to have a pressing force, rotating the bracket in a direction in which the pick-up roller descends when the shaft rotates in a predetermined direction, and having its one end inserted into a first insertion groove formed in the bracket; and a clutch sleeve being a pipe-type member surrounding the clutch spring and comprising a second insertion groove into which the other end of the clutch spring is inserted.

The flag may protrude from an outer circumferential surface of the clutch sleeve. A slit may be formed in the document feed tray to accommodate a lower end of the document stopper.

Additional aspects and/or advantages of the invention will be set forth in part in the description which follows and, in part, will be inherent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
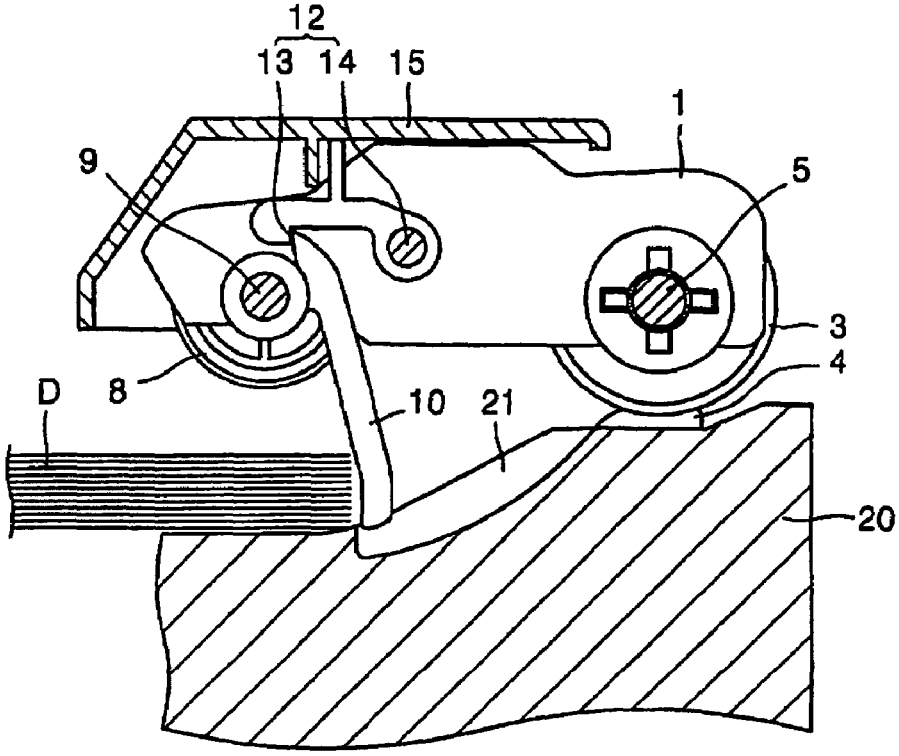
FIG. 1 (PRIOR ART)
FIG. 1 is a sectional view of a conventional automatic document feeding (ADF) device.

Reference will now be made in detail to the embodiments of the present invention, examples of which are illustrated in the accompanying drawings, wherein like reference numerals refer to the like elements throughout. The embodiments are described below to explain the present invention by referring to the figures. The invention may, however, be embodied in many different forms and should not be construed as being limited to the embodiments set forth therein; rather, these embodiments are provided so that this disclosure will be thorough and complete, and will fully convey the concept of the invention to those skilled in the art.

Figure 2:
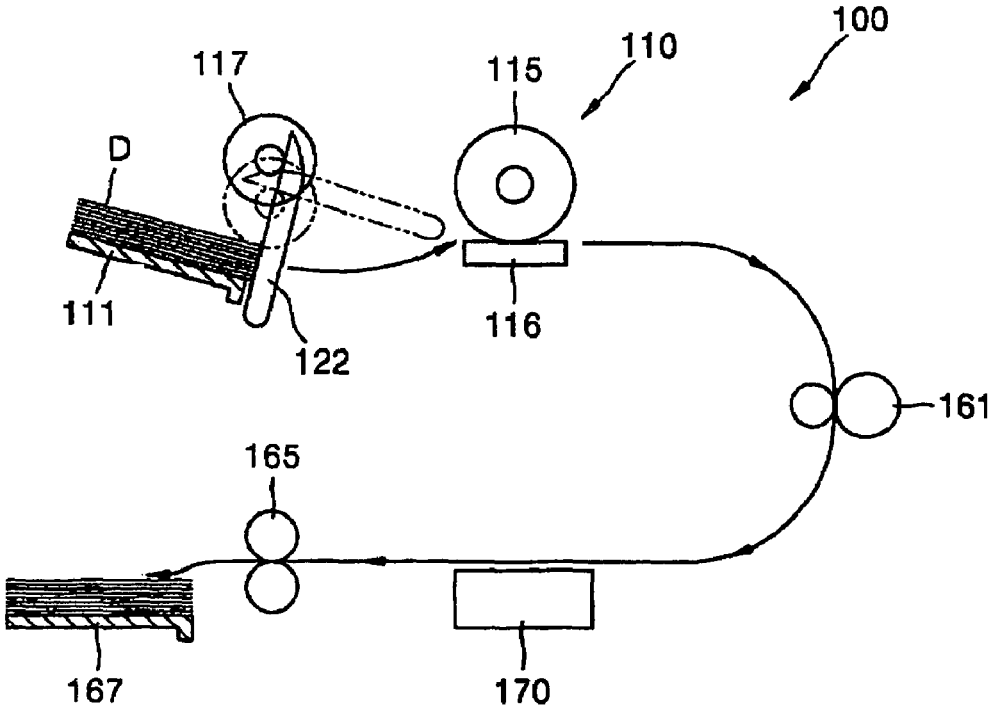
FIG. 2 is a schematic view of an image forming apparatus according to an embodiment of the present invention.
Figure 3:
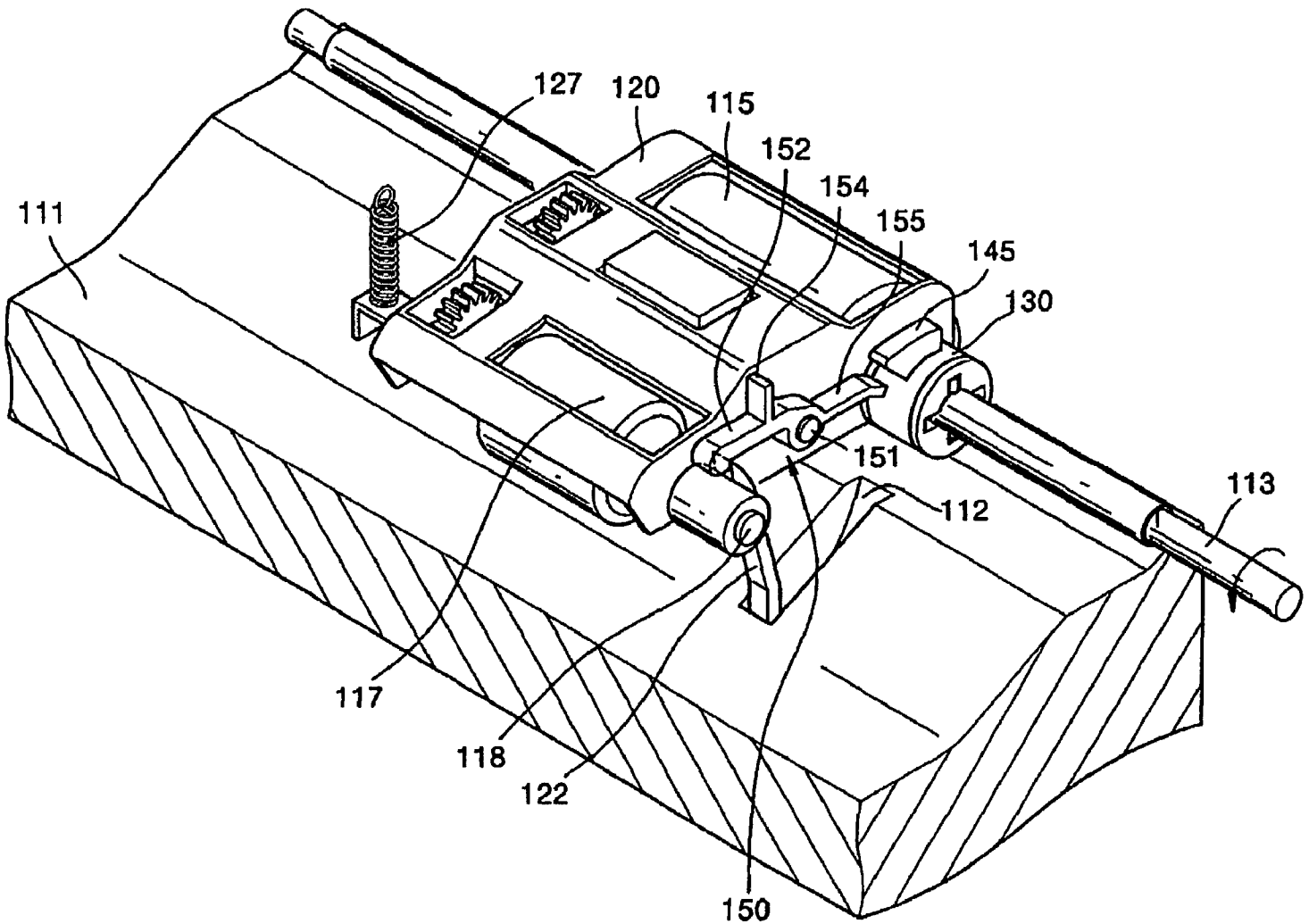
FIG. 3 is a perspective view of an ADF device according to an embodiment of the present invention.
Figure 4:
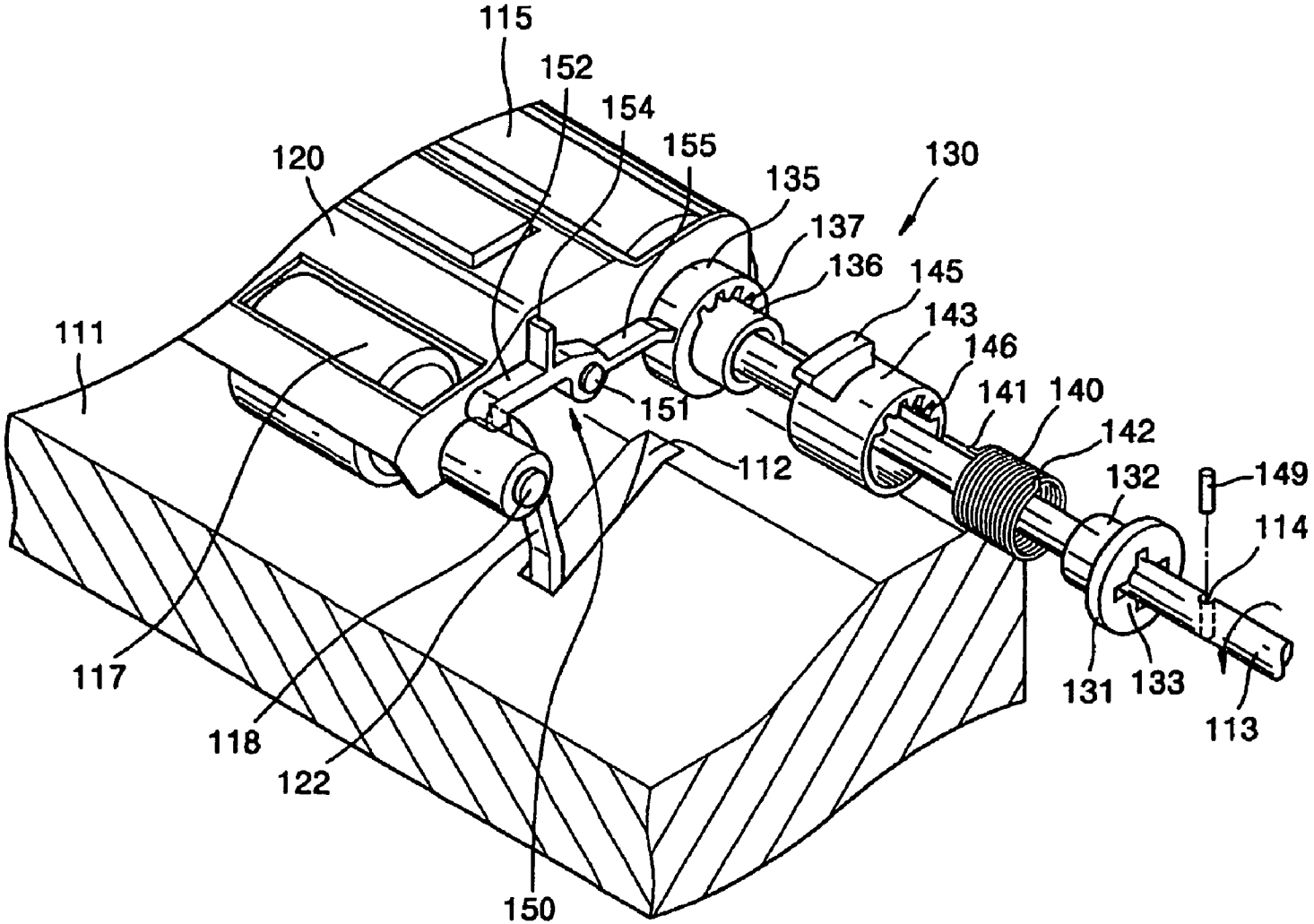
FIG. 4 is an exploded perspective view of a portion of the ADF device of FIG. 3.
Figure 5:
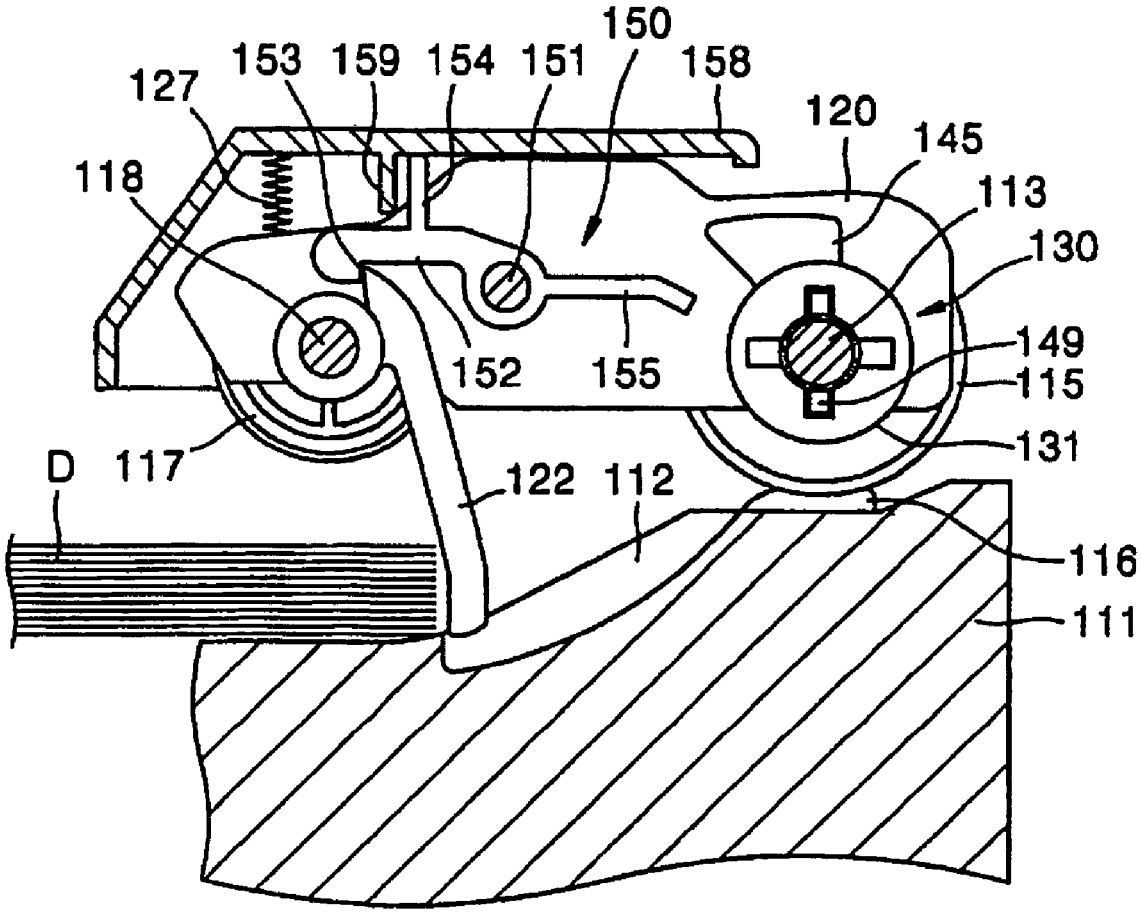
FIGS. 5 through 7 are sectional views of the ADF device of FIG. 3, which sequentially illustrate processes of unlocking a document stopper and picking up documents.
Figure 6:
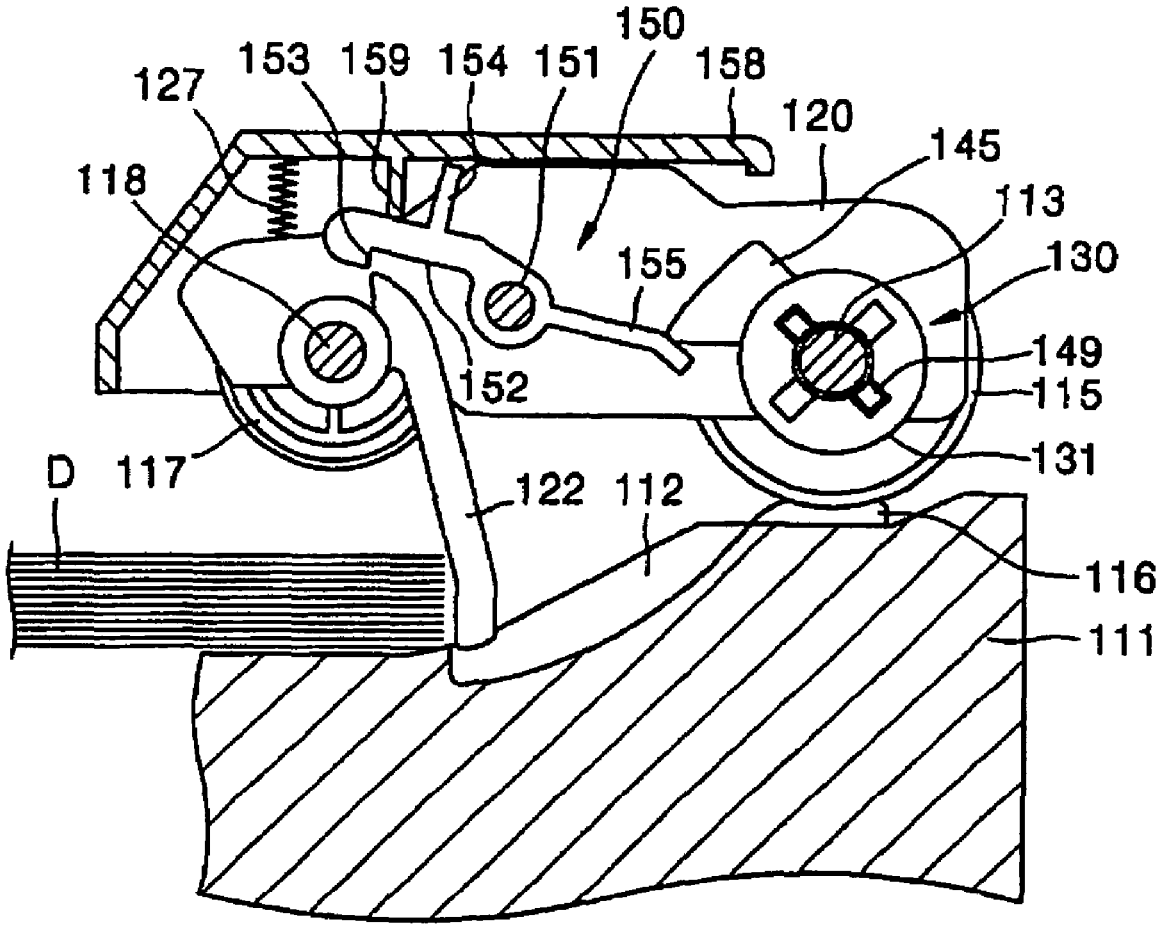
Figure 7:
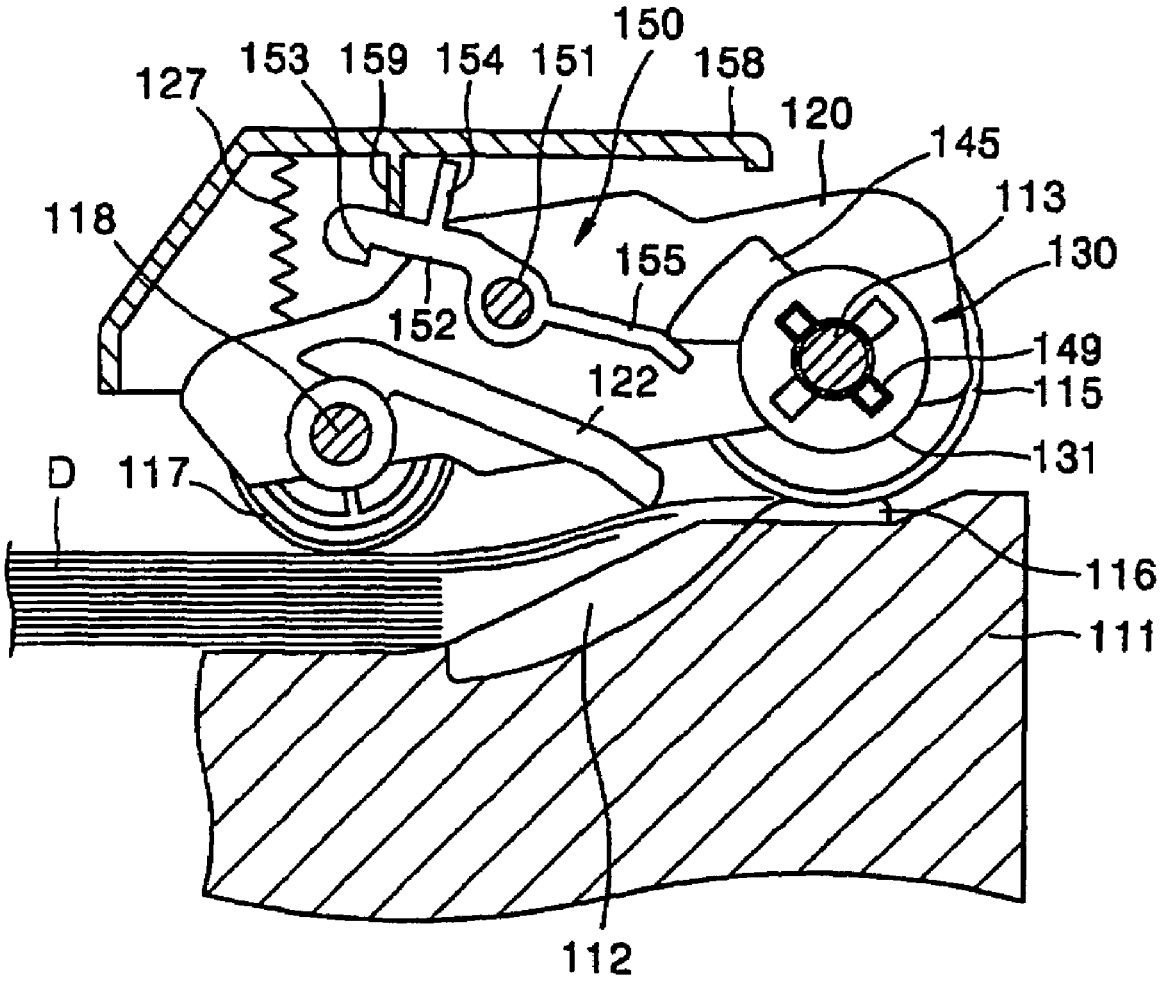

FIG. 2 is a schematic view of an image forming apparatus 100 according to an embodiment of the present invention. FIG. 3 is a perspective view of an automatic document feeding (ADF) device 110 according to an embodiment of the present invention. FIG. 4 is an exploded perspective view of a portion of the ADF device 110 of FIG. 3. FIGS. 5 through 7 are sectional views of the ADF device 110 of FIG. 3, which sequentially illustrate processes of unlocking a document stopper 122 and picking up documents.

Referring to FIG. 2, the image forming apparatus 100 having a scanning function includes a scanning unit 170 scanning images recorded on documents D and the ADF device 110 feeding the documents D to the scanning unit 170. Further, the image forming apparatus 100 includes a feeding roller 161 providing a transporting force to the documents D fed by the ADF device 110, an exit roller 165 exiting the documents D with the images scanned from the image forming apparatus 100, and a document exit tray 167 wherein the exited documents D are stacked.

The ADF device 110 feeds the documents D to the scanning unit 170 one by one. The ADF device 110 includes a document feed tray 111 wherein a plurality of documents D are stacked, a pickup roller 117 which rotates while in contact with an uppermost document D of the documents D and picks up one through several documents D, an ADF roller 115 which rotates while in contact with the picked-up documents D and feeding each of the picked-up documents D to the scanning unit 170, and an ADF pad 116 attached to a bottom surface of the ADF roller 115. The ADF device 110 further includes the document stopper 122 blocking the documents D stacked on the document feed tray 111 and limiting a movement of the documents D.

The document stopper 122 is linked with the pickup roller 117. When the pickup roller 117 is separated from the stacked documents D as indicated in a solid line, the document stopper 122 is locked, thus limiting a movement of the documents D. However, when the pickup roller 117 descends as indicated in a chain double-dashed line, the document stopper 122 is unlocked, thus rotating in a direction in which the documents D advance. A detailed description of how the pickup roller 117 and the document stopper 122 are linked with each other will be provided later.

The scanning unit 170 may be a contact image sensor (CIS) or a charge coupled device (CCD). Each of the documents D fed by the ADF device 110 is arranged by the feeding roller 161, transported to the scanning unit 170, and passed over the scanning unit 171. The scanning unit 170 scans an image recorded on a bottom surface of each of the document Ds passing thereon, and the scanned documents D are exited by the exit roller 165 and stacked on the document exit tray 167.

The ADF device 110 will be described in detail with reference to FIGS. 3 and 4. The ADF roller 115 of the ADF device 110 is rotatably coupled to an ADF roller shaft 113 disposed rotatably on the document feed tray 111. Although not shown, a gear transmitting a rotating force of a motor to the ADF roller shaft 113 is coupled to an end of the ADF roller shaft 113, and a power switching unit, such as an electronic clutch, selectively coupling or decoupling the gear and the ADF roller shaft 113 is disposed on the same end of the ADF roller shaft 113. Accordingly, the ADF roller shaft 113 may rotate in a direction indicated by an arrow or may be stationary even when the motor is driving.

The bracket 120 containing the ADF roller 115 is rotatably coupled to the ADF roller shaft 113. A pickup roller shaft 118 is disposed rotatably inside the bracket 120, and the pickup roller 117 is coupled to the pickup roller shaft 118. A power transmitting unit including a plurality of gears is installed inside the bracket 120. Therefore, when the ADF roller shaft 113 rotates in the direction indicated by the arrow, the ADF roller 115 and the pickup roller 117 both rotate in the same direction.

When the ADF roller shaft 113 starts to rotate in the direction indicated by the arrow, the bracket 120 rotates accordingly until the pickup roller 117 descends and contacts the documents D that are stacked. The bracket 120 may be moved in such a way by a clutching unit 130. The clutching unit 130 is an assembly of a bushing 131, a clutch spring 140, a clutch sleeve 143, and a flange 135 protruding from one side of the bracket 120, which are sequentially put through the ADF roller shaft 113.

The bushing 131 and the flange 135 include a bushing cylinder 132 and a flange cylinder 136, respectively, in a direction facing each other. The clutch spring 140 is a coil spring, and a diameter of its coil is designed to be slightly less than those of the bushing cylinder 132 and the flange cylinder 136. The clutch spring 140 may be forcibly inserted into the bushing cylinder 132 and the flange cylinder 136. Accordingly, the clutch spring 140 has a pressing force toward the bushing cylinder 132 and the flange cylinder 136.

A plurality of first insertion grooves are formed in the flange 135. The clutch sleeve 143, which is a pipe-type member surrounding the clutch spring 140, includes a plurality of second insertion grooves 146 formed on its inner circumferential surface and a flag 145 protruding from its outer circumferential surface. One end 141 of the clutch spring 140 is inserted into one of the first insertion grooves 137, and the other end 142 of the clutch spring 140 is inserted into one of the second insertion grooves 146. The amount of pressure applied to the bushing cylinder 132 and the flange cylinder 136 depends on which insertion groove the clutch spring 140 is inserted into. Hence, it is possible to appropriately control the pressure applied to the bushing cylinder 132 and the flange cylinder 136 by changing the insertion grooves into which the clutch spring 140 is inserted.

A fixing pin 149, which is longer than the diameter of the ADF roller shaft 113, is inserted into a pin hole 114 formed in the ADF roller shaft 113. The fixing pin 149 is inserted into a groove 133 formed in the bushing 131 while both ends of the fixing pin 149 protrude from an outer circumferential surface of the ADF roller shaft 113. Consequently, the bushing 131 and the bushing cylinder 132 are fixed to the ADF roller shaft 113.

With this structure of the clutching unit 130, when the ADF roller shaft 113 starts to rotate in the direction indicated by the arrow, a resulting rotating force is sequentially transmitted to the bushing cylinder 132, the clutch spring 140, and the flange cylinder 136. Then, the bracket 120 rotates in a direction in which the pickup roller 117 descends, and the clutch sleeve 143 rotates in the same direction as the direction in which the ADF roller shaft 113 rotates.

When the pickup roller 117 contacts the documents D stacked on the document feed tray 111, the one end 141 of the clutch spring 140, which is inserted into one of the first insertion grooves 137, stops rotating whereas the other end 142 rotates a little further in the direction in which the ADF roller shaft 113 rotates due to friction with the bushing cylinder 132. Then, the coil diameter of the clutch spring 140 increases, but does not pressure the bushing cylinder 132. Therefore, although the ADF roller shaft 113 rotates further in the direction indicated by the arrow, its rotating force is not transmitted to the bracket 120. Consequently, only the ADF roller 115 and the pickup roller 117 rotate.

The document stopper 122 is rotatably coupled to the pickup roller shaft 118 to facilitate rotation about the same axis as the pickup roller 117 rotates about, and is disposed outside the bracket 120. A slit 112 is formed in the document feed tray 111 to accommodate a lower end of the document stopper 122 extending down to the document feed tray 111. Thus, the advance of lower documents D of the documents D that are stacked on the document feed tray 111 may also be restricted by the document stopper 122.

The document stopper 122 is selectively locked by a latch arm 150, thus being prevented from rotating. Referring to FIGS. 5 through 7, the latch arm 150 is rotatably coupled to a cover 158 disposed on the bracket 120. The cover 158 may be fixed to a housing (not shown) that forms a covering of the image forming apparatus 100. The latch arm 150 includes a head portion 152 having a hook 153 that locks an upper end of the document stopper 122 on its one end based on a rotation axis 151 and a tail portion 152 extending toward the clutch unit 130 on its other end. When the flag 145 formed in the clutch sleeve 143 rotates, the tail portion 155 is pushed by the flag 145 and descends. In this case, the head portion 152 disposed on an opposite side ascends, and the upper end of the document stopper 122 breaks away from the hook 153, thus being released from the hook 153.

If the tail portion 155 is heavier than the head portion 152, the head portion 152 that ascends due to a descent of the tail portion 155 pushed by the flag 145 does not descend again even when the flag 145 returns to its original position, thus hindering locking the document stopper 122 again. Thus, the design of the latch arm 150 calls for the head portion 152 to be heavier than the tail portion 155.

If a rotation range of the latch arm 150 is too wide, it may also hinder locking of the document stopper 122. Hence, the ADF device 110 includes a unit to limit the rotation range of the latch arm 150. The unit includes a protrusion 159 protruding down from an inner surface of the cover 158 and a leaf 154 protruding up from the latch arm 150.

A spring 127 elastically biasing the bracket 120 in a direction in which the pickup roller 117 ascends is interposed between the bracket 120 and the cover 158.

An operation of the ADF device 110 will be described with reference to FIGS. 5 through 7.

While waiting for a scan command after stacking the documents D to be scanned on the document feed tray 111, the upper end of the document stopper 122 is caught on and locked in the hook of the latch arm 150, thus preventing the documents D from advancing toward the ADF roller 115. Thus, the documents D are arranged to have their front ends disposed under the pickup roller 117.

When a scan command is transmitted to the image forming apparatus 100, the ADF roller shaft 113 starts to rotate in the counter-clockwise direction. Here, if friction working between the hook 153 of the latch arm 150 and the upper end of the document stopper 122 is sufficient, the document stopper 122 is locked. Therefore, the bracket 120 does not rotate temporarily and remains suspended.

However, since the clutch sleeve 143 of FIG. 4 rotates in accordance with the ADF roller shaft 113, the flag 145 rotates in the counter-clockwise direction and pushes the tail portion 155 of the latch arm 150 as illustrated in FIG. 6. As the latch arm 150 rotates, the head portion 152 of the latch arm 150 ascends, thus unlocking the document stopper 122. In the meantime, since the head portion 152 collides with the protrusion 159 of the cover 158 and stops, the rotation range of the latch arm 150 in a clockwise direction is limited.

As the document stopper 122 is unlocked, the bracket 120 rotates until the pickup roller 117 descends and comes into contact with the uppermost document D of the documents D stacked on the document feed tray 111 as illustrated in FIG. 7. When the pickup roller 117 contacts the documents D, even though the ADF roller shaft 113 continuously rotates by the clutch unit 130, its rotating force is no longer transmitted to the bracket 120. Consequently, only the ADF roller 115 and the pickup roller 117 continue to rotate and feed the documents D one by one to the scanning unit 170 of FIG. 2. In this case, the document stopper 122 is pushed by the documents D that are fed and its lower end retreats toward the ADF roller 115. Then, the spring 127 interposed between the cover 158 and the bracket 120 is stretched.

When there is no document D left after all the stacked documents D are fed, the ADF roller shaft 113 stops, and the spring 127 is elastically restored. Accordingly, the bracket 120 rotates in the clockwise direction, and the pickup roller 117 ascends. As the clutch sleeve 143 rotates in accordance with the bracket 120 and the flag 145 returns to its original position, the latch arm 150 rotates in the counter-clockwise direction and the head portion 152 of the latch arm 150 descends.

The rotation range of the latch arm 150 in the counter-clockwise direction is restricted as far as the leaf 154 collides with the protrusion 159 of the cover 158. The upper end of the document stopper 122 that ascends in accordance with the pickup roller 117 is caught on the hook 153 of the head portion 152 that descends. Therefore, the document stopper 122 is locked again as illustrated in FIG. 5.

An ADF device and an image forming apparatus including the same according to the present invention have the following effects.

First, although a plurality of documents are stacked on a document feed tray, since a document stopper may be consistently unlocked, paper jams caused by a failure to pick up the documents may be prevented. In addition, the stalling of a motor due to a failure to unlock the document stopper can be prevented.

Second, there is no need to have a separate motor to unlock the document stopper, which not only simplifies the configuration of the ADF device, thus lowering manufacturing costs, but also reduces the power consumption required to drive the separate motor.

In one embodiment, an image forming apparatus comprises a scanning unit scanning images recorded on documents and an automatic document feeding device feeding the documents one by one to the scanning unit, the automatic document feeding device comprising: a roller feed assembly rotatably picking up the documents by using a rotating force and rotatably transporting documents one by one; and a document control unit proximate to the roller feed assembly to control movement of the documents at the roller feed assembly. The roller feed assembly generally comprises a pick-up roller rotatably picking up the documents by using a rotating force and an automatic document feeding roller rotatably transporting documents from the pick-up roller one by one.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An automatic document feeding device comprising:

a document feed tray where documents are stacked;

a shaft rotatably disposed on the document feed tray;

an automatic document feeding roller rotatably coupled to the shaft and transporting the documents one by one;

a bracket rotatably coupled to the shaft;

a pick-up roller rotatably coupled to the bracket and picking up the documents stacked on the document feed tray by using a rotating force received from the shaft;

a document stopper disposed to be able to rotate about the same axis as the pick-up roller rotates about and limiting a movement of the documents stacked on the document feed tray;

a latch arm locking the document stopper to limit the movement of the documents and prevent the document stopper from rotating; and a flag rotatably coupled to the shaft and pushing the latch arm to unlock the document stopper, wherein the automatic document feeding device further comprises a cover disposed near the bracket and having a protrusion proximate to the latch arm, and the latch arm is rotatably coupled to the cover, and wherein the latch arm further comprises a leaf that collides with the protrusion of the cover to restrict rotation of the latch arm in a counter-clockwise direction, wherein the automatic document feeding device further comprises a clutching unit comprising:

a clutch spring inserted into a bushing fixed to the shaft and a flange formed in the bracket to have a pressing force, rotating the bracket in a direction in which the pick-up roller descends when the shaft rotates in a predetermined direction, and having one end inserted into a first insertion groove formed in the bracket; and a clutch sleeve being a pipe-type member surrounding the clutch spring and comprising a second insertion groove into which the other end of the clutch spring is inserted, and the flag protrudes from an outer circumferential surface of the clutch sleeve.

2. The automatic document feeding device of claim 1, wherein the automatic document feeding device further comprises a head portion having a hook that locks the document stopper on one end of the latch arm based on a rotation axis of the latch arm and a tail portion that is pushed by the flag on the other end of the latch arm.

3. The automatic document feeding device of claim 2, wherein the head portion of the latch arm is heavier than the tail portion.

4. The automatic document feeding device of claim 2, further comprising a unit to restrict a rotation range of the latch arm.

5. The automatic document feeding device of claim 1, wherein the automatic document feeding further comprises a spring interposed between the bracket and the cover that elastically biases the bracket in a direction in which the pick-up roller ascends.

6. The automatic document feeding device of claim 1, wherein a slit is formed in the document feed tray to accommodate a lower end of the document stopper.

7. An image forming apparatus comprising a scanning unit scanning images recorded on documents and an automatic document feeding device feeding the documents one by one to the scanning unit, the automatic document feeding device comprising:

a document feed tray wherein the documents are stacked a shaft rotatably disposed on the document feed tray;

an automatic document feeding roller rotatably coupled to the shaft and transporting the documents one by one;

a bracket rotatably coupled to the shaft;

a pick-up roller rotatably coupled to the bracket and picking up the documents stacked on the document feed tray by using a rotating force received from the shaft;

a document stopper disposed to be able to rotate about the same axis as the pick-up roller rotates about and limiting a movement of the documents stacked on the document feed tray;

a latch arm locking the document stopper to limit the movement of the documents and prevent the document stopper from rotating; and a flag rotatably coupled to the shaft and forcing the latch arm to unlock the document stopper, wherein the automatic document feeding device further comprises a cover disposed near the bracket and having a protrusion proximate to the latch arm, and the latch arm is rotatably coupled to the cover, and wherein the latch arm further comprises a leaf that collides with the protrusion of the cover to restrict rotation of the latch arm in a counter-clockwise direction, wherein the automatic document feeding device further comprises a clutching unit comprising:

a clutch spring inserted into a bushing fixed to the shaft and a flange formed in the bracket to have a pressing force, rotating the bracket in a direction in which the pick-up roller descends when the shaft rotates in a predetermined direction, and having one end inserted into a first insertion groove formed in the bracket; and a clutch sleeve being a pipe-type member surrounding the clutch spring and comprising a second insertion groove into which the other end of the clutch spring is inserted, and the flag protrudes from an outer circumferential surface of the clutch sleeve.

8. The image forming apparatus of claim 7, wherein the automatic document feeding device further comprises a head portion having a hook that locks the document stopper on one end of the latch arm based on a rotation axis of the latch arm and a tail portion that is pushed by the flag on the other end of the latch arm.

9. The image forming apparatus of claim 8, wherein the head portion of the latch arm is heavier than the tail portion.

10. The image forming apparatus of claim 8, wherein the automatic document feeding device further comprises a unit to restrict a rotation range of the latch arm.

11. The image forming apparatus of claim 7, wherein the automatic document feeding device further comprises a spring interposed between the bracket and the cover that elastically biases the bracket in a direction in which the pick-up roller.

12. The image forming apparatus of claim 7, wherein a slit is formed in the document feed tray to accommodate a lower end of the document stopper.

13. An automatic document feeding device comprising:

a pick-up roller rotatably picking up the documents received by using a rotating force;

an automatic document feeding roller in a bracket and rotatably transporting documents from the pick-up roller one by one; and a document control unit proximate to the pick-up roller to control movement of the documents at the pick-up roller, wherein the document control unit comprises:

a document stopper disposed to rotate about a same axis as the pick-up roller rotates about and limiting a movement of the documents;

a latch arm locking the document stopper to limit the movement of the documents and prevent the document stopper from rotating; and a flag rotatably coupled to push the latch arm to unlock the document stopper, wherein the automatic document feeding device further comprises a cover disposed near the bracket and having a protrusion proximate to the latch arm, and the latch arm is rotatably coupled to the cover, and wherein the latch arm further comprises a leaf that collides with the protrusion of the cover to restrict rotation of the latch arm in a counter-clockwise direction, wherein the automatic document feeding device further comprises a clutching unit comprising:

a clutch spring inserted into a bushing fixed to the shaft and a flange formed in the bracket to have a pressing force, rotating the bracket in a direction in which the pick-up roller descends when the shaft rotates in a predetermined direction, and having one end inserted into a first insertion groove formed in the bracket; and a clutch sleeve being a pipe-type member surrounding the clutch spring and comprising a second insertion groove into which the other end of the clutch spring is inserted, and the flag protrudes from an outer circumferential surface of the clutch sleeve.

14. The automatic document feeding device of claim 13, wherein the latch arm comprises a head portion having a hook that locks the document stopper on one end of the latch arm based on a rotation axis of the latch arm and a tail portion that is pushed by the flag on the other end of the latch arm.

15. The automatic document feeding device of claim 14, wherein the head portion of the latch arm is heavier than the tail portion.

16. An image forming apparatus comprising a scanning unit scanning images recorded on documents and an automatic document feeding device feeding the documents one by one to the scanning unit, the automatic document feeding device comprising:

a roller feed assembly rotatably picking up the documents by using a rotating force and rotatably transporting documents one by one;

a document control unit proximate to the roller feed assembly to control movement of the documents at the roller feed assembly, wherein the roller feed assembly comprises a pick-up roller rotatably picking up the documents by using a rotating force and an automatic document feeding roller in a bracket and rotatably transporting documents from the pick-up roller one by one, and wherein the document control unit comprises:

a document stopper disposed to rotate about a same axis as the pick-up roller rotates about and limiting a movement of the documents;

a latch arm locking the document stopper to limit the movement of the documents and prevent the document stopper from rotating; and a flag rotatably coupled to push the latch arm to unlock the document stopper, wherein the automatic document feeding device further comprises a cover disposed near the bracket and having a protrusion proximate to the latch arm, and the latch arm is rotatably coupled to the cover, and wherein the latch arm further comprises a leaf that collides with the protrusion of the cover to restrict rotation of the latch arm in a counter-clockwise direction, wherein the automatic document feeding device further comprises a clutching unit comprising:

a clutch spring inserted into a bushing fixed to the shaft and a flange formed in the bracket to have a pressing force, rotating the bracket in a direction in which the pick-up roller descends when the shaft rotates in a predetermined direction, and having one end inserted into a first insertion groove formed in the bracket; and a clutch sleeve being a pipe-type member surrounding the clutch spring and comprising a second insertion groove into which the other end of the clutch spring is inserted, and the flag protrudes from an outer circumferential surface of the clutch sleeve.

17. The image forming apparatus of claim l6, wherein the latch arm is comprises a head portion having a hook that locks the document stopper on one end of the latch arm based on a rotation axis of the latch arm and a tail portion that is pushed by the flag on the other end of the latch arm.

18. The image forming apparatus of claim 17, wherein the head portion of the latch arm is heavier than the tail portion.

19. An automatic document feeding device comprising:

a document feed tray wherein documents are stacked;

a shaft rotatably disposed on the document feed tray;

an automatic document feeding roller rotatably coupled to the shaft and transporting the documents one by one;

a bracket rotatably coupled to the shaft;

a pick-up roller rotatably coupled to the bracket and picking up the documents stacked on the document feed tray by using a rotating force received from the shaft;

a document stopper limiting a movement of the documents stacked on the document feed tray;

a latch arm locking the document stopper to limit the movement of the documents and prevent the document stopper from rotating; and a flag rotatably coupled to the shaft and pushing the latch arm to unlock the document stopper, wherein the distance between the axis of the latch arm and the axis of the pick-up roller is shorter than the distance between the axis of the latch arm and the axis of the automatic document feeding roller, wherein the automatic document feeding device further comprises a cover disposed near the bracket and having a protrusion proximate to the latch arm, and the latch arm is rotatably coupled to the cover, and wherein the latch arm further comprises a leaf that collides with the protrusion of the cover to restrict rotation of the latch arm in a counter-clockwise direction, wherein the automatic document feeding device further comprises a clutching unit comprising:

a clutch spring inserted into a bushing fixed to the shaft and a flange formed in the bracket to have a pressing force, rotating the bracket in a direction in which the pick-up roller descends when the shaft rotates in a predetermined direction, and having one end inserted into a first insertion groove formed in the bracket; and a clutch sleeve being a pipe-type member surrounding the clutch spring and comprising a second insertion groove into which the other end of the clutch spring is inserted, wherein the flag protrudes from an outer circumferential surface of the clutch sleeve.

20. The automatic document feeding device of claim 19, wherein the distance between the axis of the document stopper and the axis of the pick-up roller is less than the distance between the axis of the document stopper and the axis of the latch arm.

21. The automatic document feeding device of claim 20, wherein the latch arm comprises a head portion having a hook that locks the document stopper on one end of the latch arm based on a rotation axis of the latch arm and a tail portion that is pushed by the flag on the other end of the latch arm.

22. The automatic document feeding device of claim 21, wherein a weight of the head portion of the latch arm is greater than a weight of the tail portion of the latch arm.

23. The automatic document feeding device of claim 21, further comprising a unit to restrict a rotation range of the latch arm.

24. The automatic document feeding device of claim 20, wherein the automatic document feeding device further comprises a spring interposed between the bracket and the cover that elastically biases the bracket in a direction in which the pick-up roller ascends.

25. The automatic document feeding device of claim 20, wherein a slit is formed in the document feed tray to accommodate a lower end of the document stopper.

* * * * *

UNITED STATES PATENT AND TRADEMARK OFFICE

CERTIFICATE OF CORRECTION

PATENT NO. : 7,571,905 B2
APPLICATION NO. : 11/138269
DATED : August 11, 2009
INVENTOR(S) : Won-taek Kim It is certified that error appears in the above-identified patent and that said Letters Patent is hereby corrected as shown below:

Column 1, Line 9, change "10-2004-0038747,filed" to --10-2004-0038747, filed--.

Column 9, Line 5, after "feeding" insert --device--.

Column 9, Line 17, change "stacked" to --stacked;--.

Column 10, Line 3, change "roller." to --roller ascends.--.

Column 11, Line 31, after "arm" delete "is".

Signed and Sealed this

Seventeenth Day of November, 2009

David J. Kappos

David J. Kappos
*Director of the United States Patent and Trademark Office*